US007673751B2

(12) United States Patent
Keiger

(10) Patent No.: US 7,673,751 B2
(45) Date of Patent: Mar. 9, 2010

(54) RETENTION PACKAGING

(75) Inventor: Stephen A. Keiger, Copley, OH (US)

(73) Assignee: KPC-Master's Craft International, Inc., Massillon, OH (US)

( * ) Notice: Subject to any disclaimer, the term of this patent is extended or adjusted under 35 U.S.C. 154(b) by 140 days.

(21) Appl. No.: 11/941,061

(22) Filed: Nov. 15, 2007

(65) Prior Publication Data

US 2008/0110788 A1 May 15, 2008

Related U.S. Application Data

(60) Provisional application No. 60/865,847, filed on Nov. 15, 2006.

(51) Int. Cl.
*B65D 73/00* (2006.01)

(52) U.S. Cl. ..... 206/478; 206/497

(58) Field of Classification Search ..... 206/477, 206/478, 497, 521, 583, 591, 592, 594; 281/19.1, 281/34

See application file for complete search history.

(56) References Cited

U.S. PATENT DOCUMENTS 3,572,767 A * 3/1971 Learned et al. ..... 281/34
4,915,231 A 4/1990 Perbet et al.
5,029,900 A * 7/1991 Axelrod ..... 281/34
5,033,252 A 7/1991 Carter
5,388,701 A 2/1995 Ridgeway
5,405,000 A 4/1995 Hagedon et al.
5,752,721 A * 5/1998 Balbas ..... 281/19.1
5,759,146 A 6/1998 Wilkinson
5,762,200 A 6/1998 Goudreau
5,893,460 A 4/1999 Castro et al.
5,893,462 A 4/1999 Ridgeway
5,967,327 A 10/1999 Jones
6,010,003 A * 1/2000 Wilkinson ..... 206/478
6,047,831 A 4/2000 Jones
6,073,761 A * 6/2000 Jones ..... 206/583
6,148,590 A 11/2000 Ridgeway et al.
6,302,274 B1 10/2001 Ridgeway
6,308,828 B1 10/2001 Jones (Continued)

OTHER PUBLICATIONS

Information Disclosure Statement (IDS) Letter Regarding Common Patent Application(s), submitted by Applicant on Jul. 28, 2009.

*Primary Examiner*—Luan K Bui
(74) *Attorney, Agent, or Firm*—Tillman Wright, PLLC; Chad D. Tillman; Jeremy C. Doerre

(57) ABSTRACT

A retention packaging includes a support member having first and second sections each defining a support surface for receiving an object thereon for shipping; and a film disposed in covering relation to the support surface of the support member and retained to the support member at the first and second sections. The first and second sections are pivotably connected to one another along a fold line that substantially transects the support member. The film includes opposite ends each enclosing a respective opposite end of the support member and defining overlapping areas of the film that are permanently joined together. The first section of the support member extends between the overlapping areas of one of the opposite ends of the film, and the second section of the support member extends between the overlapping areas of the other of the opposite ends of the film.

6 Claims, 5 Drawing Sheets

U.S. PATENT DOCUMENTS 6,399,184 B1 6/2002 Jones
6,409,496 B1 6/2002 Jones
6,490,844 B1 12/2002 Jones
6,675,973 B1 1/2004 McDonald et al.
2006/0138018 A1* 6/2006 McDonald et al. ..... 206/583

* cited by examiner

RETENTION PACKAGING

CROSS-REFERENCE TO RELATED APPLICATION

The present application is a U.S. nonprovisional patent application of, and claims priority under 35 U.S.C. §119(e) to, U.S. provisional patent application Ser. No. 60/865,847, filed Nov. 15, 2006, which provisional patent application is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

Retention packaging designs are well known. A typical retention packaging includes a rigid platform or backing against which an object is held and a pliable film that covers the object and that is tensioned in order to securely hold the object against the backing. Known retention packaging designs are disclosed, for example, in U.S. Pat. No. 6,675,973 to McDonald et al. ("McDonald") and U.S. Pat. No. 6,010,003 to Wilkinson ("Wilkinson"), each of which is hereby incorporated herein by reference.

In this respect, McDonald discloses a retention packaging that includes a backing having end flaps and a middle portion. An object is supported on the middle portion of the backing and a pliable film is extended over the object. The film furthermore includes pockets at opposite ends thereof that surround and enclose the end flaps of the backing. When the end flaps are folded down in a direction away from the object, the film is tensioned and stretched over the object and, thereby, retains the object against the middle portion of the backing. A stated benefit of the retention packaging of McDonald is that the film and the backing may be separately manufactured at different facilities geographically distant from one another and then shipped to and assembled at a common location by simply inserting the end flaps of the backing into the pockets formed in the ends of the film.

In contrast to McDonald, Wilkinson discloses a retention packaging that includes a backing and a pliable film that extends between opposite ends of the backing. The film is folded over and affixed to the rear of each of the opposite ends of the backing. When the backing is folded, the film is stretched over an object placed between the backing and the film, and the object is thereby suspended on the backing by the tensioned film.

While the retention packaging of McDonald and the retention packaging of Wilkinson are fit for their intended purposes, an improved retention packaging and method of manufacture nevertheless are desirable.

SUMMARY OF THE INVENTION

The present invention includes many aspects and features.

In a first aspect of the invention, a retention packaging includes: a support member having first and second sections each defining a support surface for receiving an object thereon for shipping; and a film disposed in covering relation to the support surface of the support member and retained to the support member at the first and second sections. The first and second sections are pivotably connected to one another along a fold line that substantially transects the support member. The film includes opposite ends each enclosing a respective opposite end of the support member and defining overlapping areas of the film that are permanently joined together. The first section of the support member extends between the overlapping areas of one of the opposite ends of the film, and the second section of the support member extends between the overlapping areas of the other of the opposite ends of the film.

In various features of this aspect: the fold line generally bisects the support member; the film is retained to the support member only by extension of the first and second sections of the support member between the overlapping areas of the film; the first and second sections of the support member are disposed in substantially overlapping, abutting relation to one another; edges of the first and second sections of the support member coincide with one another; the first and second sections of the support member are approximately equal in length and width; the first and second sections of the support member have approximately equal surface area; the overlapping areas of the film that are permanently joined together are heat sealed, adhered, or welded together; the film comprises a stretchable film; the film comprises polyethylene; the film comprises a heat shrinkable material; the support member is scored along the fold line; and the support member comprises a rigid material. Furthermore, the support member may be formed, for example, from chip-board, corrugated fiberboard, cardboard, a plastic sheet, or plywood. The support member also may be hinged or perforated along the fold line.

In additional features of this aspect, the retention packaging includes an object suspended on a support surface of the support member by the film; and the retention packaging includes an object suspended on each support surface of the support member by the film.

In still yet another feature of this aspect, the aforementioned retention packaging is disposed within a shipping container having an interior cargo space defined by a length, a height, and a width, wherein the first and second sections of the support member are disposed in substantially overlapping, abutting relation to one another and wherein each of the first and second sections has a length and width that is generally the same as the length and width of the interior cargo space of the shipping container.

In a second aspect of the invention, a shipping container includes a box having an interior cargo space defined by a length, a height, and a width, and a retention packaging positioned within the interior cargo space of the box. The retention packaging includes a support member that defines a support surface and having first and second sections pivotably connected to one another along a fold line that transects the support member, and a film disposed in covering relation to the support surface of the support member and retained to the support member at the first and second sections. The film includes opposite ends each defining overlapping areas of the film that are permanently joined together, with the first section of the support member extending between the overlapping areas of one of the opposite ends of the film, and with the second section of the support member extending between the overlapping areas of another of the opposite ends of the film. The first and second sections of the support member are disposed in substantially overlapping, abutting relation to one another and each of the first and second sections has a length and width that is generally the same as the length and width of the interior cargo space of the box.

In yet another aspect of the invention, a method of making a retention packaging includes the steps of: (a) positioning both a film and a support member such that the film extends in covering relation to a surface of the support member, beyond a leading edge of the support member, beyond a trailing edge of the support member, and beyond opposite side edges of the support member; (b) folding opposite side edges of the film over the opposite side edges of the support member; (c) folding opposite side edges of the film such that the film forms first overlapping areas proximate and beyond the leading edge of the support member; (d) permanently joining the first overlapping areas of the film together; (e) cutting the film proximate the first overlapping areas; (f) folding opposite side edges of the film such that the film forms second overlapping areas proximate and beyond the trailing edge of the support member; (g) permanently joining the second overlapping areas of the film together; and (h) cutting the film proximate the second overlapping areas. The film is retained to the support member by the opposite side edges of the film that are folded over the opposite side edges of the support member in conjunction with the permanently joined overlapping areas of the film that are proximate and beyond the leading and trailing edges of the support member.

In various features of this aspect: the film of step (a) extends from a roll of film; step (d) is performed prior to performance of step (e); step (d) and step (e) are performed concurrently; step (g) is performed prior to performance of step (h); step (g) and step (h) are performed concurrently; step (c) is performed prior to performance of step (f); step (c) and step (f) are performed concurrently; step (e) is performed prior to performance of step (h); step (e) and step (h) are performed concurrently; step (d) is performed prior to performance of step (g); and step (d) and step (g) are performed concurrently.

Still yet in accordance with another feature, the method further includes the step of scoring the support member between opposite side edges of the support member such that a score line transects the support member and defines first and second sections of the support member that are pivotably connected to one another along the score line. Additionally, the overlapping areas may include coinciding edges of the film that are sealed using heat sealing, ultrasonic sealing, or sealing using an adhesive such as glue or other bonding agent. Moreover, the coinciding edges may be completely sealed along their extent or sealed only at distinct points along their extent.

In addition to the aforementioned aspects and features of the present invention, it should be noted that the present invention further includes the various possible combinations of such aspects and features.

BRIEF DESCRIPTION OF THE DRAWINGS

Further aspects, features, embodiments, and advantages of the present invention will become apparent from the following detailed description with reference to the drawings, wherein.

DETAILED DESCRIPTION

Figure 1:
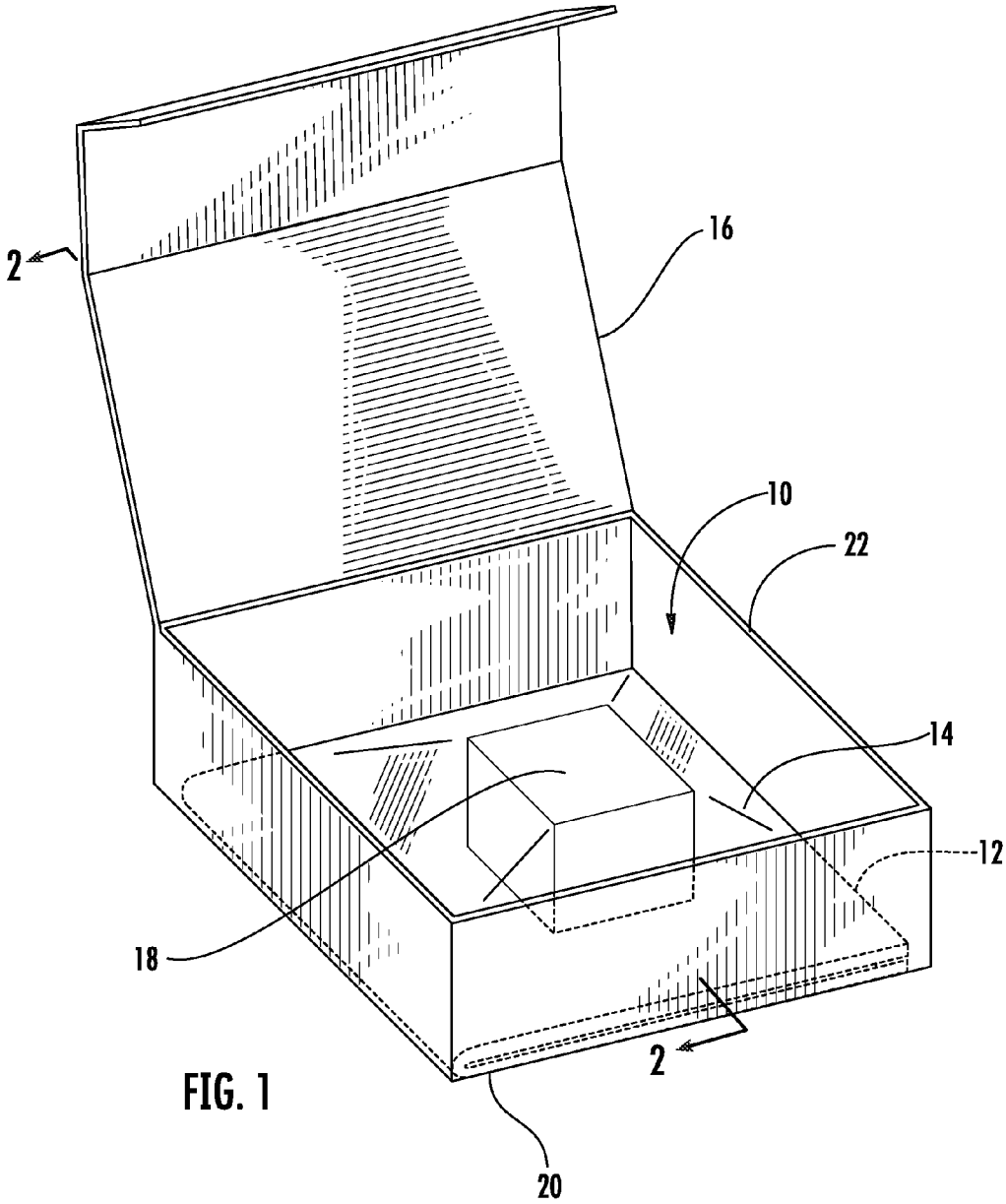
FIG. 1 is a perspective view of a shipping container including a box containing a retention packaging in accordance with a preferred embodiment of the present invention, wherein the retention packaging retains an object for shipment.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit aspects of the invention, its applications, or its uses.

Figure 2:
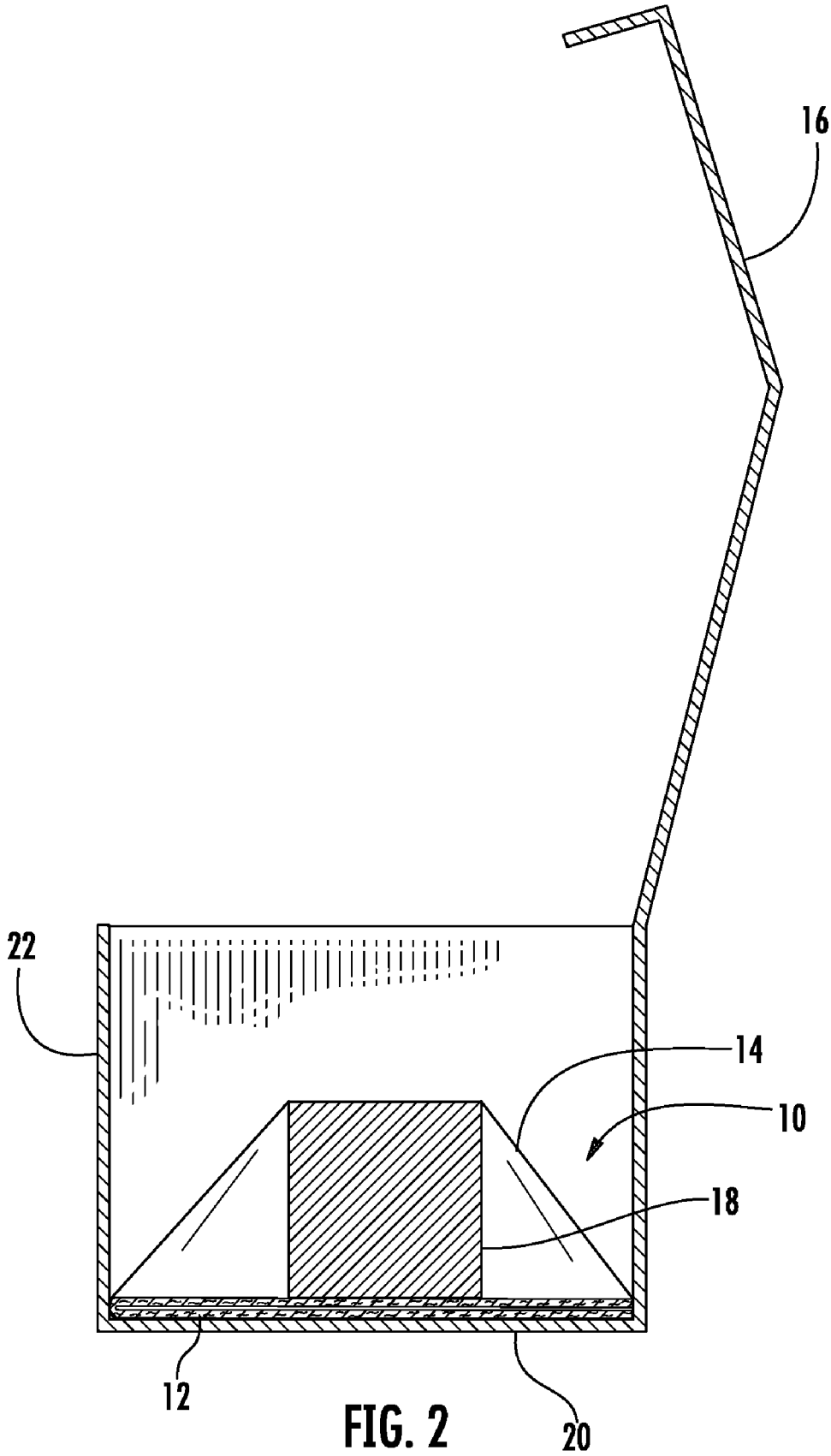
FIG. 2 is a side cross-sectional view of the box and retention packaging of FIG. 1 taken along the line 2-2.

FIGS. 1 and 2 illustrate a retention packaging 10 disposed in a shipping container for transport. For purposes of illustration, the shipping container is illustrated in the form factor of a box 16. The retention packaging 10 retains an object 18 from movement within the box 16 during transport in order to avoid jostling of, and possible damage to, the object 16. More particularly, FIG. 1 is a perspective view of a box 16 containing a retention packaging 10 in accordance with a first preferred embodiment of the present invention. FIG. 2 is a side, cross-sectional view of the box 16 and retention packaging 10 taken along the line 2-2 of FIG. 1.

The retention packaging 10 includes a support member 12 and a film 14. As shown in FIGS. 1 and 2, the retention packaging 10 is disposed in a shipping configuration, which is described in greater detail below. However, it will be noted that, when in the shipping configuration, the film 14 of the retention packaging 10 is stretched over the object 18 and is tensioned so as to inhibit movement of the object 18 during transport of the box 16. The Ordinary Artisan will understand that the film 14 may be formed from any suitable plastic film material. Examples include polypropylene, PVC, linear low density polyethylene, or hybrid biaxially oriented shrink film. Further, the film 14 may have a memory characteristic such that when the object 18 is removed from the retention packaging 10, the film 14 will retain an impression therein of the object 18 so that the object 18—or an object having a similar shape—may then be placed in the retention packaging 10 for subsequent transport, with the film 14 corresponding to the shape of the object for a shape-conforming fit of the object.

It also is contemplated that the film 14 further may be heat shrunk over the object 18 prior to the retention packaging 10 being placed into the box 16 (provided the film is heat shrinkable). The heating shrinking would be performed according to conventional heat shrinking methods and, therefore, a detailed description of such heat shrinking is not included herein.

Typically, once an object 18 to be shipped has been placed in the retention packaging 10 and the retention packaging 10 has been arranged in the shipping configuration, the retention packaging 10 is placed in the box 16, with the support member 12 resting against a base 20 of the box 16. The film 14 of the retention packaging 10 holds the object 18 against the support member 12 and suspends the object 18 away from walls 22 of the box 16 so that the object 18 does not collide with the walls 22 of the box 16 during transport. The support member 12 of the retention packaging 10 also provides a buffer between the object 18 and the base 20 of the box 16. An additional buffer (not shown) also may be provided on top of the retention packaging 10 to secure the retention packaging 10 in its abutment with the base 20 of the box 16.

Figure 3:
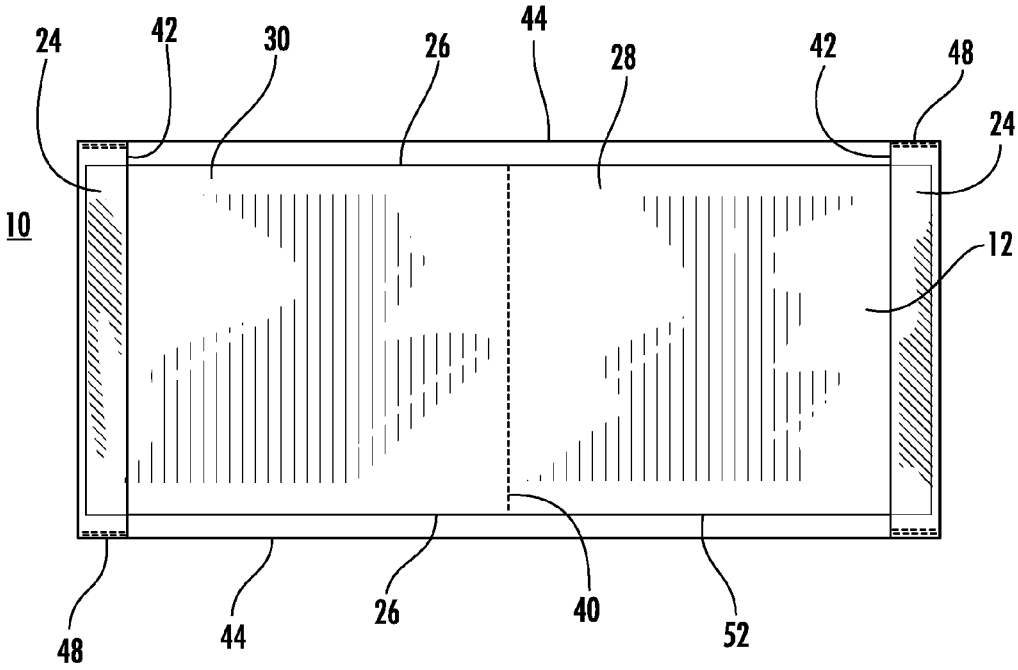
FIG. 3 is a top plan view of the retention packaging of FIG. 1, shown before the object has been loaded therein.
Figure 4:
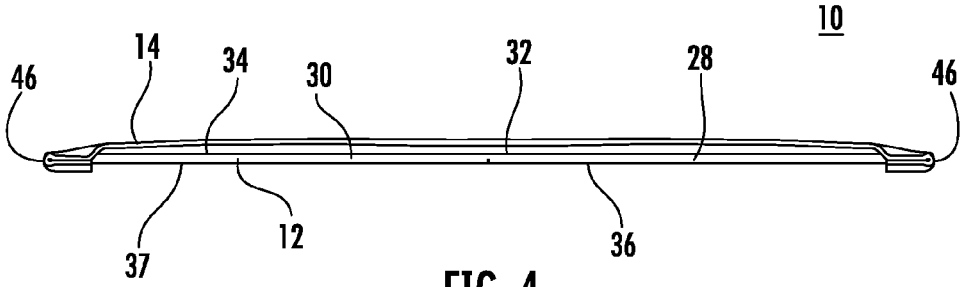
FIG. 4 is a side plan view of the retention packaging of FIG. 3 shown before the object has been loaded therein.

FIG. 3 is a top plan view, and FIG. 4 is a side plan view, of the retention packaging 10 of FIG. 1 before the object 18 has been loaded therein. As shown in FIGS. 3 and 4, the support member 12 of the retention packaging 10 includes a quadrilateral perimeter having opposite ends 24 and sides 26. A fold line 40 transects the support member 12 and defines a first section 28 and a second section 30. Each section 28,30 has, respectively, a top surface 32,34 and a bottom surface 36,37. The film 14 is disposed in covering relation to the top surfaces 32,34 of the first and second sections 28,30 of the support member 14, with the opposite ends 24 of the support member 12 extending within the receiving areas 46 of the film 14. A retaining space 50 is thereby defined between the film 14 and the support member 12 wherein an object 18 to be transported or shipped may be placed. Horizontal planes of the first and second sections 28,30 of the support member 12 are generally aligned when the retention packaging 10 is in this configuration, which results in relaxation of the film 14 compared to the shipping configuration. An object may be placed on either of the top surfaces 32,34. Once an object 18 to be shipped is inserted into the retaining space 50 and placed on the top surface of one of the two sections 28,30 of the support member 12, the section of the support member 12 that is not supporting the object 18 is rotated away from the object 18. Consequently, it is preferred that the object 18 not overlap a perimeter 52 of the section of the support member 12 on which it is placed.

Described in more detail, the fold line 40 demarcates the first and second sections 28,30 from each other and provides an axis of rotation for the first and second sections 28,30 relative to one another. Preferably, the fold line 40 bisects the support member 12 such that the surface areas of the first section 28 and the second section 30 are approximately equal. The film 14 includes opposite ends 42 and sides 44. The film 14 is disposed in covering relation to the support member 12. More particularly, the film 14 extends in covering relation to the top surfaces 32,34 of the first and second sections 28,30 of the support member 12. The film 14 further extends beyond the ends 24 of the support member 12, and ends 42 of the film 14 respectively wrap around the ends 24 of the support member 12 and partially cover portions of the bottom surfaces 36,37. The opposite ends 42 of the film 14 also are folded around the corresponding opposite ends 24 of the support member 12 such that folded portions of the film 14 define receiving areas 46 within which opposite ends 24 of the support member 12 are received and at least are partially enclosed. For each receiving area 46, overlapping areas comprising coinciding edges 48 of the portion of the film 14 forming the receiving area 46 are permanently jointed together to maintain the fold forming the receiving area 46. Various methods are available for permanently joining the edges 48 together. Examples includes heat sealing, ultrasonic sealing, and use of various adhesives, such as glue. Furthermore, a discrete point or discrete points along the edges 48 may be permanently joined together or, alternatively, the entire edges 48 of the portions of the film 14 forming the receiving areas 46 may be permanently joined together.

In loading an object in the retention packaging 10, one of the sections 28,30 is pivoted upwardly about fold line 40 relative to the other section, thereby loosening the film 14 and forming an insertion pocket for easy loading of the object onto one of the top surfaces 32,34. In so folding, the first and second sections 28,30 may tend to form an "L" or "V" shaped configuration. Once the object is loaded onto a top surface of one of the sections 28,30, the other section is then pivoted downwardly about fold line 40 relative to the section supporting the object, which begins to tension and tighten the film 14 about the object.

Figure 5:
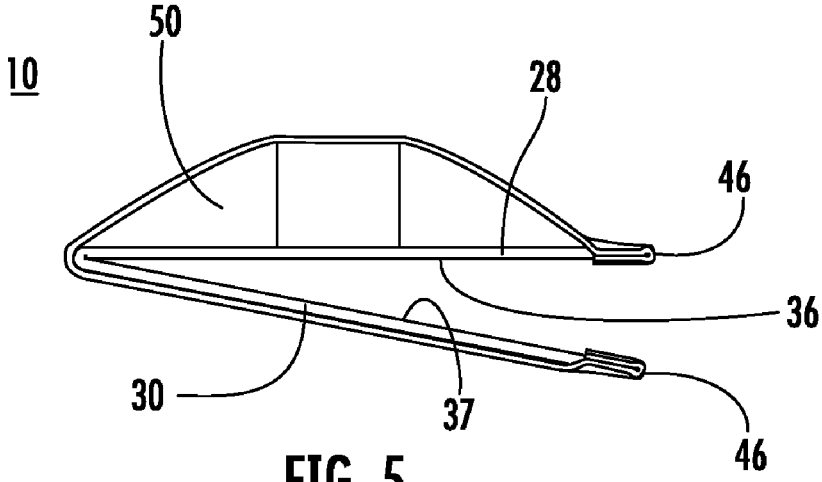
FIG. 5 is a side plan view of the retention packaging of FIG. 3 with an object placed therein and the support member partially folded about the fold line.
Figure 6:
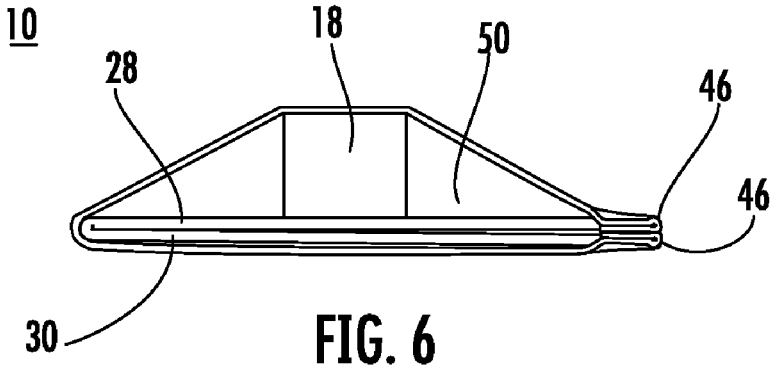
FIG. 6 is a side plan view of the retention packaging and object of FIG. 5 in a shipping configuration.

FIGS. 5 and 6 illustrate the tensioning of the film as this pivoting action transitioned to the shipping configuration. In particular, FIG. 5 is a side plan view of the retention packaging 10, with the object 18 placed therein during transitioning to the shipping configuration. For exemplary purposes, the object 18 is shown in FIG. 5 as having been placed upon—and is being supported by—the first section 28. Accordingly, with continuing reference to FIG. 5, the second section 30 is rotated about the fold line 40 downwardly and away from the object 18 and the support surface of the first section 28. As the second section 30 is folded away from the object 18, the film 14 is tensioned and stretched over the object 18. The further the second section 30 is rotated, the tighter the film 14 is stretched across the object 18, and the stretched and tensioned film 14 extending over the object 18 prevents the object from sliding or shifting in the box 16 during transport. The second section 30 is folded until the bottom surface 37 of the second section 30 is disposed adjacent—and preferably in complete overlying abutment with—the bottom surface 36 of the first section 28 as shown in FIG. 6. In this arrangement, the retention packaging 10 is disposed in the shipping configuration.

Furthermore, it should be noted that for the illustrated embodiment, wherein the first section 28 and the second section 30 are the same size, the receiving areas 46 of the film 14 and opposite ends 24 of the support member 12 are aligned when the retention packaging 10 is disposed in this shipping configuration. As such, the support member 12 provides a double layer of support for the object 18 placed thereon. Accordingly, the retention packaging 10 is able to accommodate relatively heavy objects for shipping and transport. Further, the torque applied to the film 14 when the retention packaging 10 is transitioned to the shipping configuration is a product of a lever arm that equals the length of the second section 30 and is approximately half the length of the support member 12.

Figure 7:
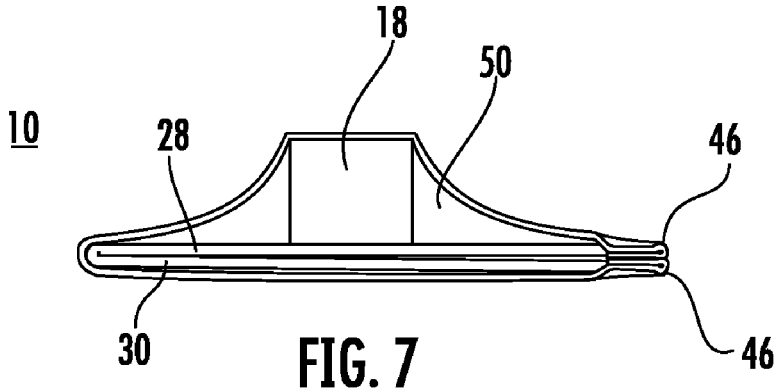
FIG. 7 is a side plan view of the retention packaging and object of FIG. 6 after heat shrinking of the retention packaging of FIG. 6.

It also is contemplated that the film 14 of the retention packaging 10 may further be heat shrunk prior to the retention packaging 10 being placed into the box 16 for shipment (provided that the film that is used is heat shrinkable). FIG. 7 illustrates an embodiment of the present invention wherein the retention packaging 10—and specifically the film 14—has been heat shrunk. In this regard, FIG. 7 illustrates the retention packaging 10 of FIG. 6 wherein the film comprises a heat shrinkable material, and wherein the retention packaging 10 of FIG. 6 has been heat shrunk via a conventional heat shrinking tunnel or other conventional heat shrinking means.

To remove an object 18 from the retention packaging 10, a person receiving the shipment merely removes the retention packing 10 and object 18 from the box 16 and then rotates the second section 30 away from its overlapping abutment with the first section 28. This relaxes and loosens the film 14, thereby permitting access to the retaining space 50 wherein the object 18 is held. The person then merely reaches into the retaining space 50, takes hold of the object 18, and removes it from the retention packaging 10.

The retention packaging 10 does not have to be damaged or torn in order to retrieve the object 18 there from. One merely pivots a support section about fold line 40 relative to the other support section to relax and loosen the film in order to remove the object 18 that was shipped therein. Further, the retention packaging 10 thereafter may be used again for shipment of a similarly shaped object. For reuse, either the original object 18 or an object having the same general shape and size as the original object 18 is placed in the retaining space 50 of the retention packaging 10. Then the retention packaging 10 is returned to the shipping configuration with the film 14 again conforming to the shape of the object, and the retention packaging 10 with the object retained therein is then placed in a box (possibly even the same box 16) for shipment. Furthermore, to the extent that the film 14 is initially stretched so as to retain a shape or memory of the original object 18, the object with which the retention packaging is reused is positioned in the same orientation so as to correspond with and conform to such stretched area of the film 14.

Figure 8:
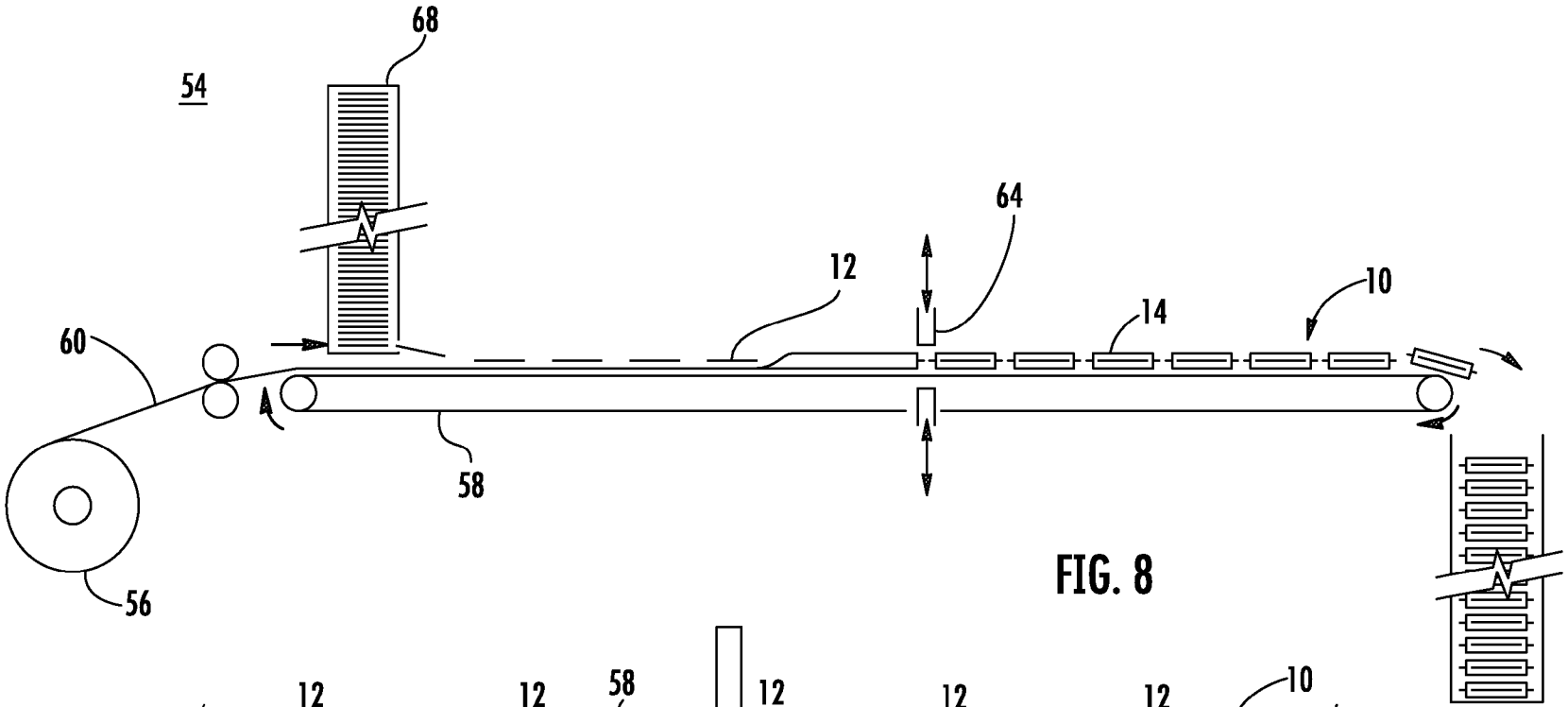
FIG. 8 is a schematic illustration from a side point of view of a method and system of manufacturing the retention packaging of FIG. 3 in accordance with preferred embodiments of the present invention.
Figure 9:
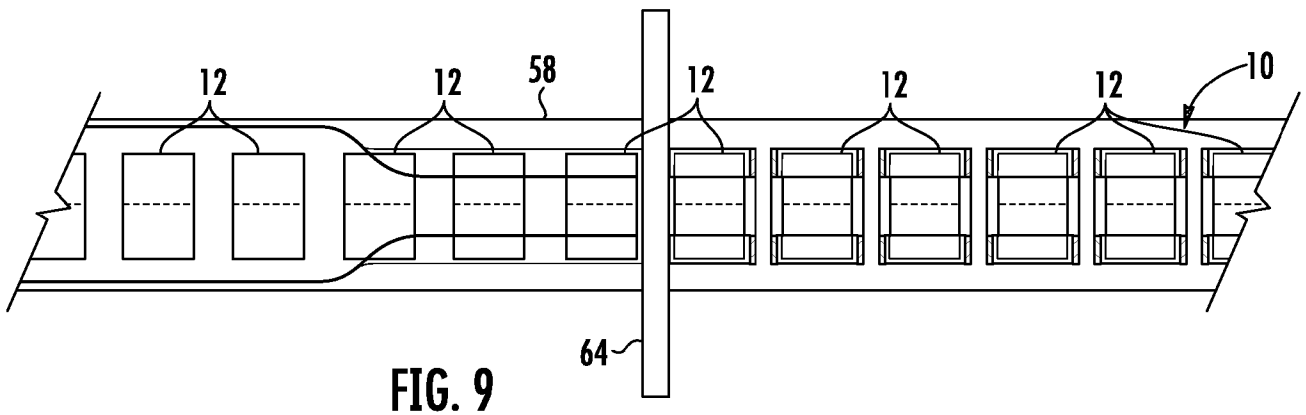
FIG. 9 is a schematic illustration from a top point of view of a portion of the manufacturing method and system of FIG. 5.

FIGS. 8 and 9 illustrate a preferred method and system 54 of manufacturing retention packaging 10. More particularly, FIG. 8 is a schematic illustration from a side point of view of the manufacturing method and system 54, and FIG. 9 is a schematic illustration from a top point of view of a portion of the manufacturing method and system 54.

In general, the manufacturing system 54 includes: a film supply roll 56; an endless conveyor belt 58 for conveying and supporting uncut film 60 as it is removed from the supply roll 56; an apparatus (not shown) both for folding opposite side edges of the film 60 around opposite side edges of the support members 12, and for folding opposite side edges of the film such that the film forms overlapping areas; and an apparatus 64 for sealing and cutting the film 60 to form permanent overlapping areas of the film 14. Furthermore, the cutting and sealing apparatus 64 may be one apparatus as shown or may be two separate apparatus. The manufacturing system 54 also includes a support member supply 68 that feeds pre-cut support members 12 onto the belt 58 supporting the film 60.

The manufacturing system 54 is arranged such that a pre-cut support member 12 is placed onto the film 60 as the film 60 is unrolled. A series of support members 12 are arranged along the conveyor belt on top of the film 60 with some incremental, predetermined space between each of the support members 12. The folding apparatus provides a folding surface that encourages opposite side edges of the film 60 to fold over on itself. This results in the opposite side edges of the film 60 folding around opposite side edges of the support member 12 as well as folding over on itself to form overlapping areas of the film in the spacing between the support member 12. Then, while the folded side edges of the film 60 are maintained in said position, the cutting and sealing apparatus 64 seals and cuts the film 60 in between the support member 12 at adjacent leading and trailing edges of the support members 12. A retention packaging 10 is thereby formed after the overlapping areas of the film 14 have been sealed and cut on both the leading edge and then trailing edge of a support member 12. The completed retention packaging 10 then continues on the conveyor belt 58 and is received in a supply container.

It further is noted that, during manufacturing, the film 14 is disposed below the support member 12 relative to the ground. Subsequently, for use, the finished retention packaging 10 is turned upside down such that the support member 12 is disposed below the film 14, in relation to the ground, for then receiving an object for shipment.

FIG. 9 provides a more detailed view of the folding, cutting and sealing process of the manufacturing system 54.

As is illustrated in FIG. 9, the support member 12 is positioned on the film 60 such that the film 60 extends beyond a leading edge of the support member 12, beyond a trailing edge of the support member 12, and beyond opposite side edges of the support member 12. As the belt 58 moves, opposite side edges of the film 60 are folded such that: the film 60 forms first overlapping areas beyond and proximate the leading edge of the support member 12; the opposite side edges of the film 60 are folded around the opposite side edges of the support member 12; and the film 60 forms second overlapping areas beyond and proximate the trailing edge of the support member 12. Such folding takes place for successive support members 12 as they progress along the conveyor belt 58.

After at least the first overlapping area is folded, the first overlapping area of the film 60 may be permanently joined together. The film 60 may also then be cut proximate the first overlapping area. Similarly, the second overlapping area of the film 60 may be permanently joined and then the film 60 may be cut proximate the second overlapping area. Typically, such sealing and cutting will occur between successive support members 12 so that sealing and cutting is occurring for a trailing edge of one support member 12 while simultaneously occurring for a leading edge of a following support member 12. After the film 14 is sealed and cut, it is retained to the support member 12 by the opposite side edges of the film 14 that are folded over opposite side edges of the support member 12 and the permanently joined overlapping areas of the film 14 that are beyond and proximate the leading and trailing edges of the support member 12.

In addition to the above outlined steps, the manufacturing process may also include scoring the support member 12 between opposite side edges of the support member 12 such that a score line 40 transects the support member 12 and defines first and second sections of the support member 12 that are pivotably connected to one another along the score line 40.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A shipping apparatus, comprising:

(a) a shipping container having an interior cargo space defined by a length, a height, and a width;

(b) a retention packaging contained within said box, said retention packaging comprising, (i) a support member having first and second sections each defining a support surface for receiving an object thereon for shipping, said first and second sections being pivotably connected to one another along a fold line that transects said support member, (ii) a film disposed in covering relation to said support surface of said support member and retained to said support member at said first and second sections, said film including opposite ends each enclosing a respective opposite end of said support member and defining overlapping areas of said film that are permanently joined together, with said first section of said support member extending between said overlapping areas of one of said opposite ends of said film, and with said second section of said support member extending between said overlapping areas of the other of said opposite ends of said film, and (iii) an object supported on said support surface of said support member with said film disposed thereover, (iv) wherein, (A) said fold line generally bisects said support member, (B) said first and second sections of said support member are disposed in substantially overlapping, abutting relation to one another, and (C) wherein said first and second sections of said support member are approximately equal in length and width;

(c) wherein said equal lengths and widths of said first and second sections of said support member are generally the same as the length and width of said interior cargo space of said shipping container.

2. The shipping apparatus of claim 1, wherein said film comprises a stretchable film.

3. The shipping apparatus of claim 1, wherein said film comprises a heat shrinkable material.

4. The shipping apparatus of claim 1, wherein said support member comprises a rigid material.

5. The shipping apparatus of claim 1, wherein said film is retained to said support member only by extension of said first and second sections of said support member between said overlapping areas of said film.

6. The shipping apparatus of claim 1, wherein said overlapping areas of said film that are permanently joined together are heat sealed, adhered, or welded together.

* * * * *

UNITED STATES PATENT AND TRADEMARK OFFICE

CERTIFICATE OF CORRECTION

PATENT NO. : 7,673,751 B2
APPLICATION NO. : 11/941061
DATED : March 9, 2010
INVENTOR(S) : Stephen A. Keiger It is certified that error appears in the above-identified patent and that said Letters Patent is hereby corrected as shown below:

Col. 10, line 5, insert the word --box-- between the words --container-- and --having-- so that line 5 reads as follows: "a shipping container box having an interior cargo space"

Col. 10, line 10, delete the word "each" so that line 10 reads as follows: "defining a support surface for receiving an object"

Signed and Sealed this

Twenty-first Day of December, 2010

David J. Kappos

David J. Kappos
*Director of the United States Patent and Trademark Office*